US006360390B1

(12) United States Patent
Bonaddio

(10) Patent No.: US 6,360,390 B1
(45) Date of Patent: Mar. 26, 2002

(54) EDGE SUPPORT FOR A MATTRESS

(75) Inventor: Vincenzo A. Bonaddio, Boothwyn, PA (US)

(73) Assignee: Foamex L.P., Linwood, PA (US)

( * ) Notice: Subject to any disclaimer, the term of this patent is extended or adjusted under 35 U.S.C. 154(b) by 0 days.

(21) Appl. No.: 09/764,765

(22) Filed: Jan. 18, 2001

(51) Int. Cl.[7] ..... A47C 27/15
(52) U.S. Cl. ..... 5/717; 5/739; 5/740
(58) Field of Search ..... 5/691, 716, 717, 5/721, 727, 739, 740

(56) References Cited

U.S. PATENT DOCUMENTS

| | | | | |
|---|---|---|---|---|
| 1,371,362 A | | 3/1921 | Griese | |
| 1,915,659 A | | 6/1933 | Gail | |
| 2,069,415 A | | 2/1937 | Lotz | |
| 2,319,431 A | | 5/1943 | Owen | |
| 2,399,628 A | | 5/1946 | Cunningham | |
| 3,521,311 A | | 7/1970 | Cohen | |
| 4,213,214 A | | 7/1980 | Gilhooly | |
| 4,286,344 A | | 9/1981 | Ikeda | |
| 4,389,743 A | | 6/1983 | Callaway | |
| 4,679,266 A | | 7/1987 | Kraft | |
| 4,995,095 A | * | 2/1991 | Gerrick | 5/691 |
| 5,107,558 A | | 4/1992 | Luck | |
| 5,113,539 A | | 5/1992 | Strell | |
| 5,579,549 A | | 12/1996 | Selman | |
| 5,704,085 A | | 1/1998 | Sabalasky | |
| 6,088,858 A | * | 7/2000 | Juster et al. | 5/727 |
| 6,223,370 B1 | * | 5/2001 | Kluft | 5/717 |

FOREIGN PATENT DOCUMENTS

| | | |
|---|---|---|
| CH | 63/9546 A5 | 11/1983 |
| EP | 00/11755 | 6/1980 |

OTHER PUBLICATIONS

The Weekly Home Furnishings Newspaper, Oct. 17, 1994 (1994 Capital Cities Media, Inc.), pp. 20–25.
The Weekly Newspaper for the Home Furnishings Network, Apr. 24, 1995 (1995 Capital Cities Media, Inc.), pp. 8–13.
Mattress Sets (Home and Garden Buying Guide), Praeger, Anne; Consumer Digest, v. 33, n.2, p. 48(3) Mar.–Apr. 1994.

* cited by examiner

*Primary Examiner*—Michael F. Trettel
(74) *Attorney, Agent, or Firm*—Connolly Bove Lodge & Hutz LLP

(57) ABSTRACT

A mattress including (a) an innerspring, (b) one or more upholstery topper layers including an edge support that is a foam construction with at least two foam layers, and (c) one or more quilt panel layers. The at least two foam layers form the edge support or firming perimeter edge, wherein the first foam layer has (1) a defined firmness, (2) a thickness greater at its perimeter, and (3) a central portion forming a receiving space. The second foam layer has a defined firmness less than the first foam layer and is nestably insertable into the receiving space of the first foam layer. The firming perimeter edge functions to provide a firmer mattress edge without compromising the thickness of the mattress or requiring additional materials or labor during manufacturing.

20 Claims, 1 Drawing Sheet

EDGE SUPPORT FOR A MATTRESS

FIELD OF THE INVENTION

The invention relates to bed mattresses, and in particular, to mattresses incorporating a foam construction to enhance the firmness of the perimeter edge support of such mattresses.

BACKGROUND OF THE INVENTION

Mattresses are formed with a firmer perimeter edge to permit a person to sit on the edge of the mattress. The firmer edge also provides additional support that better enables a person to get up from the mattress. Without a firmer perimeter edge, the coil springs commonly found in mattress constructions to provide cushioning support for a reclining person generally would sag at the perimeter. Various approaches for providing a firmer perimeter edge, while not unnecessarily increasing the firmness of the entire mattress, have been suggested in the art.

One approach is disclosed in U.S. Pat. No. 5,704,085. The '085 patent discloses a mattress with an edge support formed by a foam layer 23 with an edge firming means as one of the upholstery topper layers. The foam layer 23 is framed by a firming edge 32 to form an edge firming perimeter. The foam layer 23 and firming edge 32 are joined together with glue or adhesive 34. The firming edge 32 is formed from a foam that is firmer than the foam layer 23. The cutting and joining are precisely controlled, and can be difficult to perform because the softer foam layer 23 is more pliable and bendable than the firming edge 32. In addition, the glue adds cost and can form a hard spot in the construction. Moreover, in time, the edges that have been glued together can separate allowing undesired shifting within the mattress construction.

SUMMARY OF THE INVENTION

The invention comprises an improvement to the mattress with a foam layer construction shown in U.S. Pat. No. 5,704,085. A mattress according to the invention incorporates an innerspring, at least one upholstery layer provided adjacent to the innerspring, at least one quilt panel layer provided adjacent to the at least one upholstery layer and a foam construction provided within the at least one upholstery layer wherein said foam construction has foam forming an edge about its perimeter that is firmer than foam of a central portion of said foam construction. The foam construction is formed from a first foam layer having a thickness greater at its perimeter and lesser at its central portion, said central portion forming a receiving space, and a second foam layer insertable within the receiving space in the first foam layer. The first foam layer has a firmness greater than the second foam layer. The second foam layer nests within the receiving space in the first foam layer. In the preferred embodiment, the second foam layer fittedly nests within the receiving space such that frictional forces between the contacting surfaces of the first and second foam layers are sufficient to maintain the second foam layer within the receiving space without applied adhesive.

Preferably, the first and second foam layers are formed from polyurethane foam, rebond foam or polyethylene foam. Polyurethane foam is most preferred. For the first foam layer, the foam preferably should have an $IFD_{25}$ in the range of 100–150. For the second foam layer, the foam preferably should have an $IFD_{25}$ in the range of 15–45.

The second foam layer has a top surface and a bottom surface and a thickness defined between the top surface and the bottom surface. The receiving space in the first foam layer has a depth defined from the bottom inner surface of the receiving space to the top surface of the first foam layer. The second foam layer preferably has a thickness that substantially matches the depth of the receiving space within the first foam layer. Thus, in such preferred embodiment, the foam construction formed by the first and second foam layers has a constant, or nearly constant, thickness along its entire length. In another embodiment, the thickness of the second foam layer exceeds the depth of the receiving space in the first foam layer to provide greater cushioning or other functionality to the portion of the mattress away from the perimeter edge. Different support characteristics may also be achieved by removing material from the top surface of the second foam layer, such as by convolute cutting or other shaping methods.

BRIEF DESCRIPTION OF THE DRAWINGS

Numerous other objects, features and advantages of the invention shall become apparent upon reading the following detailed description taken in conjunction with the accompanying drawings, in which.

DETAILED DESCRIPTION OF THE PREFERRED EMBODIMENT

Figure 1:
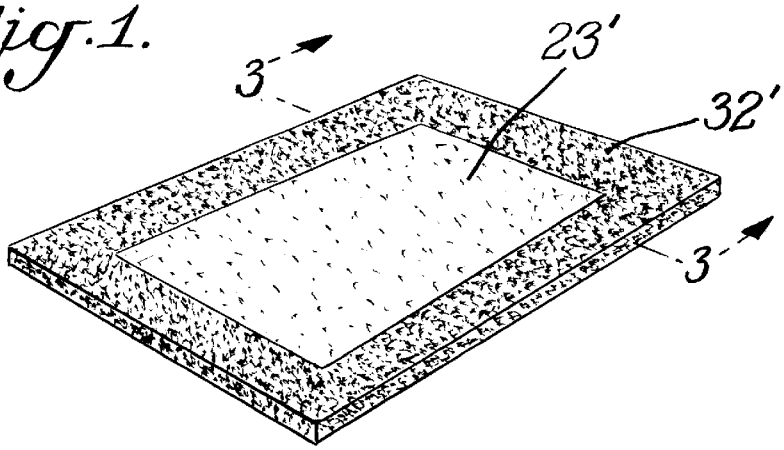
FIG. 1 is a top perspective view of a foam construction according to the present invention.
Figure 2:
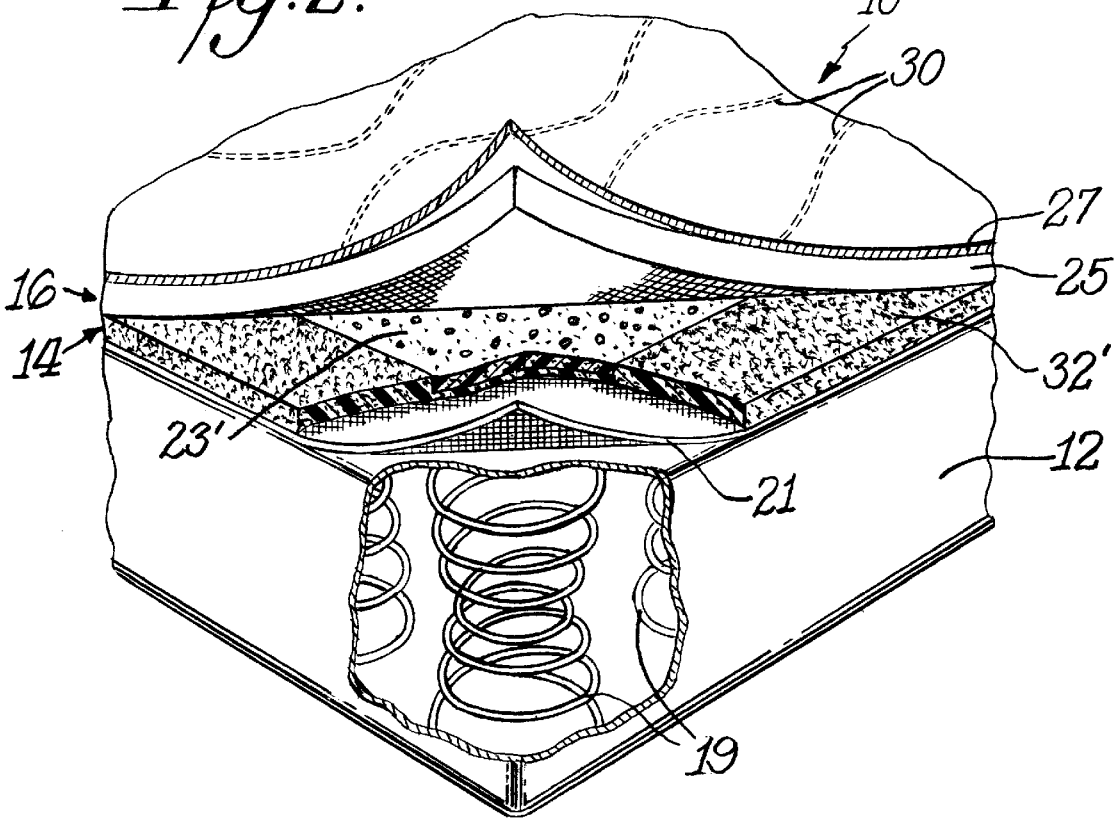
FIG. 2 is a perspective, cut-away view of a portion of a mattress constructed according to the present invention.
Figure 3:
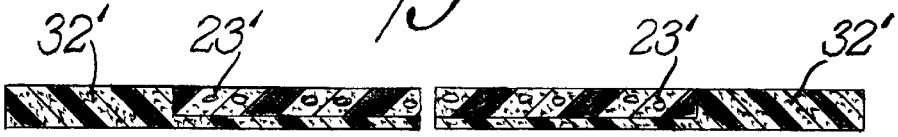
FIG. 3 is a cross-sectional view of the foam construction of FIG. 1 taken along line 3—3.

A mattress 10 made according to the principles of the present invention is shown in FIGS. 1–3. The present invention comprises an improvement to the mattress with edge support shown in U.S. Pat. No. 5,704,085. Thus, FIGS. 1–3 from the '085 patent have been duplicated, and where possible, like elements are referenced with the same reference numerals. The mattress 10 of the present invention includes an innerspring 12, upholstery topper layers 14, and quilt panel layers 16. Although the upholstery topper layer 14 and the quilt layer 16 are shown about only the top surface of the mattress 10 in FIG. 2, it should be understood that the mattress 10 is generally provided with such upholstery topper and quilt layers about both its top and bottom surfaces.

The innerspring 12 of the mattress 10 generally comprises border wires (not shown) forming a rectangular structure and, within the structure, a plurality of interconnected coil springs 19. The coil springs 19 are generally disposed in rows and columns over the entire area of the rectangular structure. The number of coils, their structure, and their arrangement depend upon the type of support to be provided and the size of the mattress.

The upholstery topper layers 14 are provided along the top and bottom surfaces of the innerspring 12. The quilt panels 16 are, in turn, provided along the top and bottom surfaces of the upholstery topper layers 14. Each upholstery topper layer 14 is constructed of a number of layers, including an insulator layer 21 constructed of, for example, wire mesh, plastic mesh, woven fabric, or non-woven fiber strands and at least one padding material layer comprised of, for example, flexible foam. In FIG. 2, the padding material layer is a foam construction 23', 32' according to the invention. Each of the quilt layers 16 is constructed of foam and/or fiber layers 25 with a covering of ticking 27. As can be seen in FIG. 2, the components of the quilt layer 16 are stitched together with thread 30 to form a quilt pattern.

In order to provide a firmer edge about the perimeter of the mattress 10, the present invention provides a foam construction 23', 32' with an edge firming means for providing a firm edge about the perimeter of the mattress 10. The edge firming means comprises a first foam layer 32' and a second foam layer 23'. The first foam layer 32' has a thickness greater at its perimeter and lesser at its central portion. The central portion of the first foam layer 32' defines a receiving space, and it is surrounded by a frame formed of the thicker perimeter portion. The second foam layer 23' is insertable within the receiving space in the first foam layer 32'. The first foam layer 32' has a firmness greater than that of the second foam layer 23'. The foam layers 23', 32' may be formed of polyurethane foam or rebond foam or polystyrene foam, preferably polyurethane foam. The foam used for the first foam layer 32' has an indentation force deflection ($IFD_{25}$) generally in the range of from 100 to 150. The foam used for the second foam layer 23' has an $IFD_{25}$ generally in the range of from 15 to 45. Thus, the foam of the first foam layer 32' is approximately 4 to 6 times firmer, and preferably 5 times firmer, than the foam for the second foam layer 23'.

The top surface of the first foam layer 32' surrounds or frames the second foam layer 23' held within the receiving space. The first foam layer 32' will have an overall length and overall width that varies depending upon the size of the mattress 10. Then, the portions of the first foam layer 32' that frame the receiving space will have a width of about four inches for a preferred embodiment standard double size mattress. Other widths for these portions may be used.

As can be seen in FIGS. 1 and 3, the first foam layer 32' frames the perimeter of the second foam layer 23'. The first foam layer 32' also holds the second foam layer 23' within the receiving space formed in the first foam layer 32'. The second foam layer 23' may be held within the receiving space and attached to the first foam layer 32' with glue, adhesive, or other bonding means, such as flame lamination. Preferably, the second foam layer 23' nestably fits within the receiving space of the first foam layer 32' and the frictional engagement between the adjacent and contacting foam surfaces is sufficient to hold the second foam layer 23' firmly within the receiving space without applied glue or adhesive.

In the preferred embodiment shown in FIGS. 1–3, the thickness of the second foam layer 23' substantially matches the depth of the receiving space within the first foam layer 32'. Accordingly, the foam construction 23'+32' has a substantially uniform thickness along its entire length. In such preferred embodiment, the thickness of the foam construction 23'+32' is approximately 1.0 to 1.5 inches, with the thickness of the second foam layer in the range of 0.5 to 0.75 inches. In alternate embodiments, the second foam layer 23' may have a thickness exceeding the depth of the receiving space within the first foam layer 32'.

In addition, although FIGS. 1–3 show a foam construction with substantially flat top and bottom surfaces, the first foam layer 23' and second foam layer 32' may be formed from convoluted foams. Alternatively, the layers may have portions of foam material removed to vary the thickness, and thus the support characteristics, of the foam material in the foam construction. In one alternate embodiment (not shown), the foam construction 23'+32' may be formed from a first foam layer 32' with substantially flat outer surfaces and a second foam layer 23' that has portions of foam material removed from its upper surface. In this way, the edge or perimeter of the mattress may be substantially firmer than the central portion of the mattress.

The foam construction 23'+32' of the present invention improves upon the foam layer 23 shown in U.S. Pat. No. 5,704,085. The foam construction 23'+32' of this invention reduces labor time and cost, eliminates the need for substantial adhesive, and is more readily installed within a mattress construction. The firmer first foam layer 32' retains and holds the softer second foam layer 23' in place. The firmer foam is easier to slide into place within the mattress construction. In addition, the surface of the second foam layer 23' may be sculpted or contoured to vary support characteristics or appearance, such as convolute cutting or cutting more complex geometries using the methods disclosed in U.S. Pat. Nos. 6,142,053 and 5,534,208. Even after such sculpting or contouring of the second foam layer, the foam construction still is readily inserted into a mattress construction.

As a person sits upon the edge of a mattress 10 made according to the present invention, their weight is supported by the quilt layers 16, the upholstery layers 14 with the firming edge in the foam construction 23'+32', and the innerspring 12. The firming edge of the foam construction better supports the person sitting on the mattress edge, and the softer central portion of the foam construction provides more comfortable cushioning as the person alternately reclines upon the mattress. The firming edge increases the height and strength of the innerspring 12 of the mattress 10 without reducing the mattress thickness or overall softness or comfort of the mattress in its center. When a load is applied, such as the weight of a person, the firming edge collapses or compresses only slightly as compared to the remainder of the upholstery layer.

While preferred embodiments of the invention have been described and illustrated here, various changes, substitutions and modifications to the described embodiments will become apparent to those of ordinary skill in the art without thereby departing from the scope and spirit of the invention.

I claim:

1. In a mattress incorporating an innerspring, at least one upholstery layer provided adjacent to the innerspring, at least one quilt panel layer provided adjacent to the at least one upholstery layer and a foam construction provided within the at least one upholstery layer wherein said foam construction has foam forming an edge about its perimeter that is firmer than foam of a central portion of said foam construction, the improvement comprising:

forming a foam construction from a first foam layer having a thickness greater at its perimeter and lesser at its central portion, said central portion forming a receiving space, and a second foam layer insertable within the receiving space in the first foam layer, wherein the first layer has a firmness greater than the firmness of the second foam layer and wherein the foam construction is integral to the upholstery layer within the mattress.

2. The mattress of claim 1, wherein the foam construction is constructed of polyurethane foam.

3. The mattress of claim 1, wherein the foam construction has a uniform thickness throughout.

4. The mattress of claim 1, wherein the second foam layer nests within the receiving space in the first foam layer.

5. The mattress of claim 1, wherein the second foam layer fittedly nests within the receiving space in the first foam layer without applied adhesive.

6. The mattress of claim 1, wherein the second foam layer has a top surface and a bottom surface and a thickness defined between the top surface and the bottom surface, and wherein the receiving space in the first foam layer has a depth, such that the thickness of the second foam layer substantially matches the depth of the receiving space in the first foam layer.

7. The mattress of claim 1, wherein the second foam layer has a top surface and a bottom surface and a thickness defined between the top surface and the bottom surface, and wherein the receiving space in the first foam layer has a depth, such that the thickness of the second foam layer exceeds the depth of the receiving space in the first foam layer.

8. The mattress of claim 1, wherein the second foam layer has a top surface and a bottom surface and a pattern on the top surface formed by removing foam material from the foam layer.

9. The mattress of claim 1, wherein the first foam layer has a firmness at least four times greater than the firmness of the second foam layer.

10. The mattress of claim 1, wherein the second foam layer is adhered to the first foam layer.

11. An edge support for use as an integral component within a mattress, comprising:

a foam construction formed from a first foam layer having a thickness greater at its perimeter and lesser at its central portion, said central portion forming a receiving space, and a second foam layer insertable within the receiving space in the first foam layer, wherein the first foam layer has a firmness greater than the firmness of the second foam layer, and wherein the foam construction is integrally placed within the mattress during fabrication of said mattress.

12. The edge support of claim 11, wherein the foam construction is formed of polyurethane foam.

13. The edge support of claim 11, wherein the foam construction has a uniform thickness throughout.

14. The edge support of claim 11, wherein the second foam layer nests within the receiving space in the first foam layer.

15. The edge support of claim 11, wherein the second foam layer fittedly nests within the receiving space in the first foam layer without applied adhesive.

16. The edge support of claim 11, wherein the second foam layer has a top surface and a bottom surface and a thickness defined between the top surface and the bottom surface, and wherein the receiving space in the first foam layer has a depth, such that the thickness of the second foam layer substantially matches the depth of the receiving space in the first foam layer.

17. The edge support of claim 11, wherein the second foam layer has a top surface and a bottom surface and a thickness defined between the top surface and the bottom surface, and wherein the receiving space in the first foam layer has a depth, such that the thickness of the second foam layer exceeds the depth of the receiving space in the first foam layer.

18. The edge support of claim 11, wherein the second foam layer has a top surface and a bottom surface and a pattern on the top surface formed by removing foam material from the foam layer.

19. The edge support of claim 11, wherein the first foam layer has a firmness at least four times greater than the firmness of the second foam layer.

20. The edge support of claim 11, wherein the second foam layer is adhered to the first foam layer.

* * * * *